US007722408B2

(12) United States Patent
Miyazaki et al.

(10) Patent No.: US 7,722,408 B2
(45) Date of Patent: May 25, 2010

(54) CONNECTOR AND CONNECTOR CONNECTING BODY

(75) Inventors: Yoji Miyazaki, Tsu (JP); Kenji Okura, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/059,147

(22) Filed: Mar. 31, 2008

(65) Prior Publication Data

US 2008/0268711 A1 Oct. 30, 2008

(30) Foreign Application Priority Data

Apr. 24, 2007 (JP) ..... P2007-114706

(51) Int. Cl.
*H01R 24/00* (2006.01)

(52) U.S. Cl. ..... 439/660; 439/570; 439/74

(58) Field of Classification Search ..... 439/570, 439/566, 74, 660
See application file for complete search history.

(56) References Cited

U.S. PATENT DOCUMENTS

| | | | | |
|---|---|---|---|---|
| 5,961,347 | A * | 10/1999 | Hsu | 439/570 |
| 6,007,352 | A * | 12/1999 | Azuma et al. | 439/108 |
| 6,579,122 | B1 * | 6/2003 | Chen | 439/570 |
| 7,112,091 | B2 * | 9/2006 | Okura et al. | 439/570 |
| 7,172,434 | B2 * | 2/2007 | Obikane et al. | 439/74 |
| 7,387,540 | B1 * | 6/2008 | Van der Steen | 439/660 |
| 2006/0051988 | A1 | 3/2006 | Okura et al. | |
| 2006/0116008 | A1 * | 6/2006 | Chen | 439/74 |
| 2006/0234525 | A1 | 10/2006 | Ookura | |
| 2006/0264075 | A1 | 11/2006 | Obikane et al. | |
| 2007/0010110 | A1 * | 1/2007 | Ono et al. | 439/74 |
| 2007/0105408 | A1 | 5/2007 | Ookura | |
| 2007/0161274 | A1 | 7/2007 | Tanaka et al. | |
| 2008/0207014 | A1 * | 8/2008 | Takeuchi et al. | 439/74 |

FOREIGN PATENT DOCUMENTS

| | | |
|---|---|---|
| CN | 1881705 | 12/2006 |
| JP | 2004-055464 A | 2/2004 |
| JP | 2005-19144 | 1/2005 |
| JP | 2006-059596 A | 3/2006 |
| JP | 2006-331679 A | 12/2006 |

OTHER PUBLICATIONS

English language Abstract of JP 2005-19144.
U.S. Appl. No. 12/059,052 to Miyazaki et al, which was filed Mar. 31, 2008.
English language Abstract of JP 2006-331679 A.
English language Abstract of JP 2006-059596 A.
English language Abstract of JP 2004-055464 A.
English language Abstract of CN 1881705, Dec. 20, 2006.

* cited by examiner

*Primary Examiner*—Hien Vu
(74) *Attorney, Agent, or Firm*—Greenblum & Bernstein P.L.C.

(57) ABSTRACT

A socket includes a socket housing of an insulator to which plural socket contacts to be soldered to a conductive pattern of a circuit substrate, and a fitting metal for fixture to the circuit substrate are attached, in which the fitting metal includes plate-like side plates that are exposed along end surfaces of the socket housing, anchors that are formed by folding the side plates to bite into the housing, and an attachment piece that protrudes from a bottom plate to outside of the socket housing to be fixed to the circuit substrate.

4 Claims, 7 Drawing Sheets

CONNECTOR AND CONNECTOR CONNECTING BODY

BACKGROUND OF THE INVENTION

1. Field of the Invention

The present invention relates to a connector in which paired connector connecting bodies are fitted and coupled to each other, thereby corresponding contacts are connected to each other, and the connecting bodies thereof.

2. Description of the Related Art

A conventional connector used for connection between substrates and the like, including a socket (one of connector connecting bodies) having a housing made of an insulator of synthetic resin or the like to which plural contacts are attached, and a header (the other connector connecting body) similarly having a housing made of an insulator to which plural contacts are attached is known (for example, Japanese Patent Application Laid-open No. 2005-19144). In this connector, the socket and the header are fitted and coupled to each other, so that the corresponding contacts are made contact conductive. Consequently, conductive patterns of the circuit substrates to which the corresponding contacts are connected are electrically connected to each other.

In an example of such a connector, a fitting metal 30P is embedded in a peripheral wall 13P of a housing 11P made of synthetic resin of a socket 10P, as shown in FIG. 1. The fitting metal 30P has attachment pieces 30*a*P protruding beyond the housing 11P. The attachment pieces 30*a*P are fixed to a circuit substrate (not shown) by soldering or the like, so that coupling strength between the socket 10P and the circuit substrate is increased. Terminals 12 TP of contacts 12P are soldered to a conductive pattern of the circuit substrate.

In the conventional connector, however, because the fitting metal 30P is embedded in the peripheral wall 13P, the peripheral wall 13P is divided by the fitting metal 30P into inner and outer portions.

That is, the peripheral wall 13P with a thickness t is divided by the fitting metal 30P into an inner portion with a thickness tin and an outer portion with a thickness tout, resulting in the thinned portions. Particularly, the outer portion with the thickness tout is broken easily due to an external force or the like.

When the fitting metal 30P is embedded in the housing 11P by insert molding, there is a risk of molten resin not sufficiently spreading into the thinned portions during the molding (so-called misrun). Particularly when the misrun occurs in the outer portion with the thickness tout, the fitting metal may be partially exposed.

An object of the present invention is to provide a connector connecting body and a connector that can eliminate a defect caused by embedding of the fitting metal into the housing.

SUMMARY OF THE INVENTION

A connector connecting body according to the present invention includes a housing of an insulator to which plural contacts to be soldered to a conductive pattern of a circuit substrate, and a fitting metal for fixture to the circuit substrate are attached, in which the fitting metal includes a plate-like body that is exposed along an outer wall of the housing, an anchor that is formed by folding the body to bite into the housing, and an attachment piece that protrudes from the body to outside the housing to be fixed to the circuit substrate.

According to the present invention, the anchors are provided on opposed ends in a longitudinal direction of the body.

According to the present invention, a plurality of the anchors extending in different directions is provided.

A connector according the present invention includes paired connector connecting bodies, and at least one of the connector connecting bodies is the connector connecting body according to the present invention.

BRIEF DESCRIPTION OF THE DRAWINGS

FIG. 4A is a view seen from inside of the socket and FIG. 4B is a view seen from outside of the socket;

FIG. 7A is a view seen from inside of the header and FIG. 7B is a view seen from outside of the header;

FIG. 9A is a front view, FIG. 9B is a plan view.

FIG. 10A is a side view of the socket housing, FIG. 10B is a plan view of an end of the socket housing, and FIG. 10C is a bottom view of the end of the socket housing; and

DETAILED DESCRIPTION OF THE PREFERRED EMBODIMENTS

Figure 1:
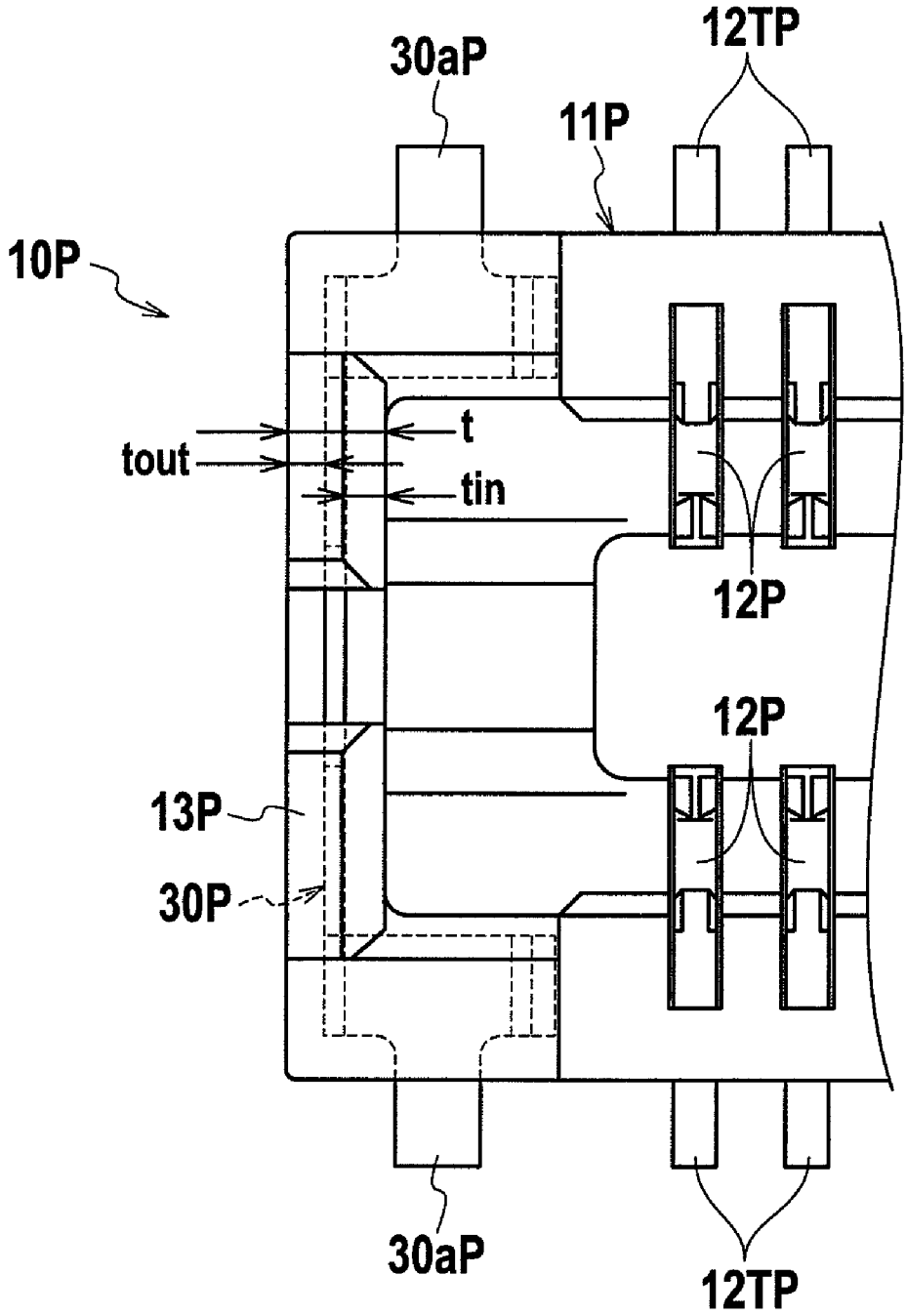
FIG. 1 RELATED ART
FIG. 1 is a plan view of an end of a socket used for a connector according to a related art.
Figure 2:
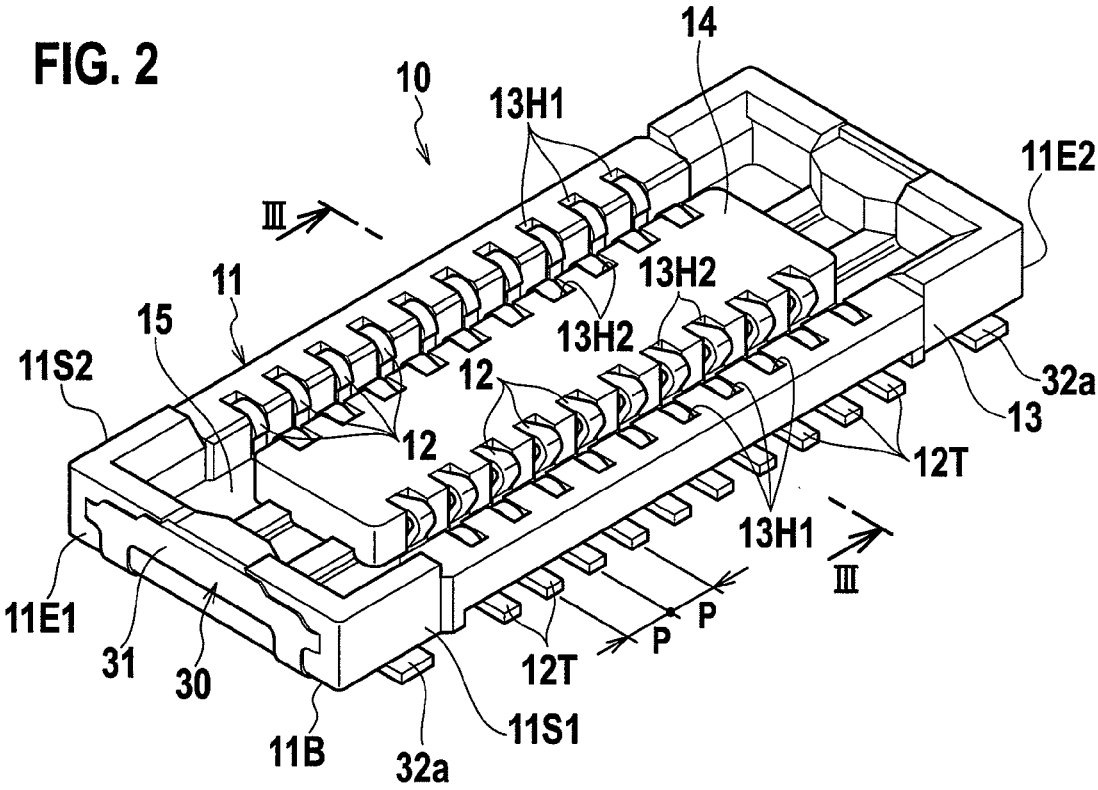
FIG. 2 is an overall perspective view of a socket that is a connector connecting body according to an embodiment of the present invention.
Figure 3:
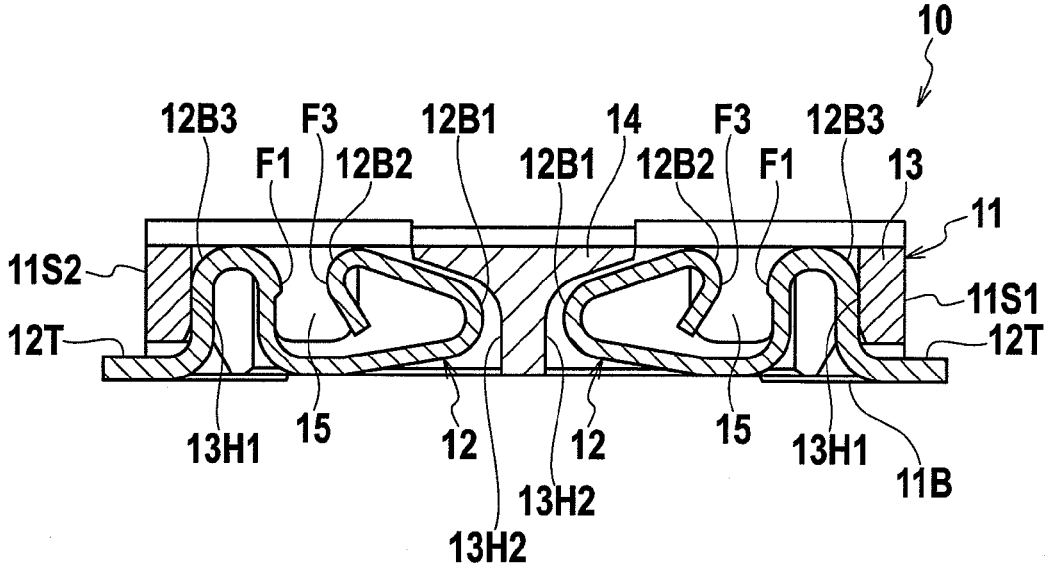
FIG. 3 is a cross section taken along a line III-III in FIG. 2.
Figure 4A:
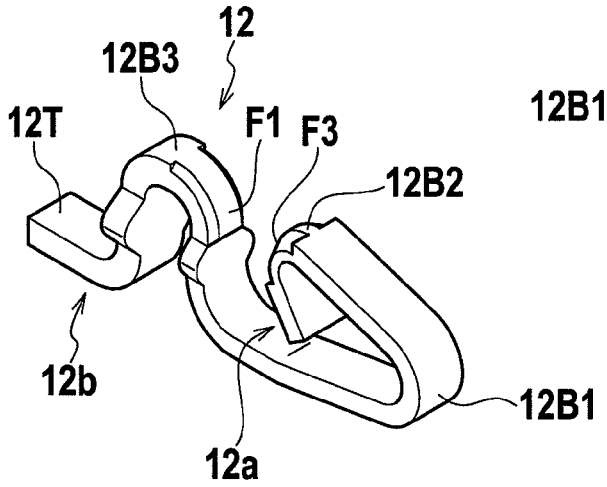
FIGS. 4A and 4B are perspective views of a socket contact included in the socket as the connector connecting body according to the embodiment, where
Figure 4B:
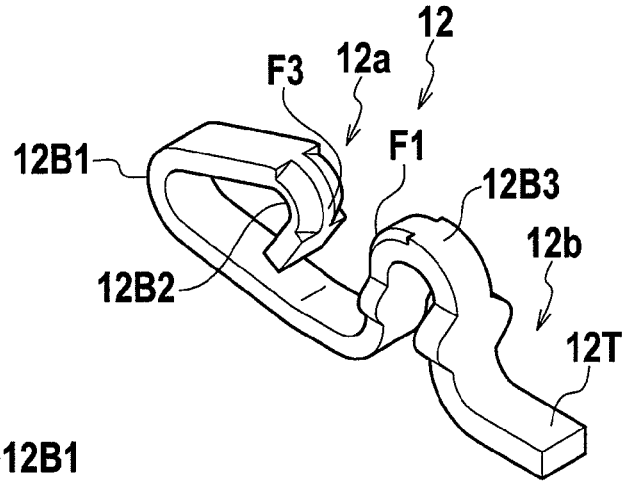
Figure 6:
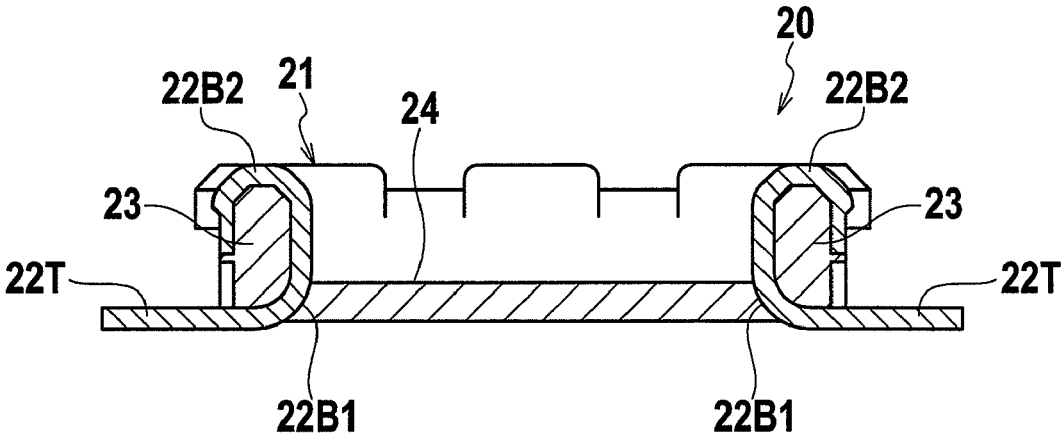
FIG. 6 is a cross section taken along a line VI-VI in FIG. 5.
Figure 7A:
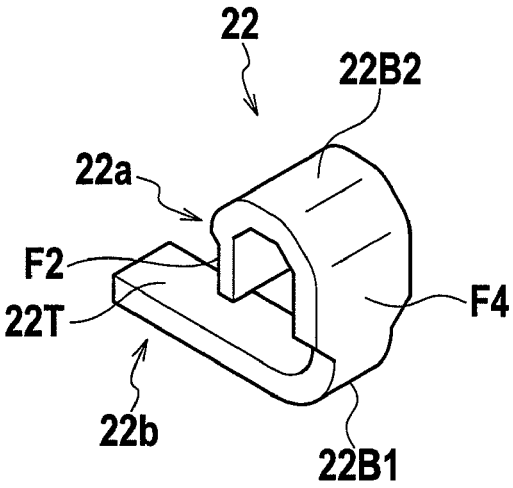
FIGS. 7A and 7B are perspective views of a header contact included in the header, where
Figure 7B:
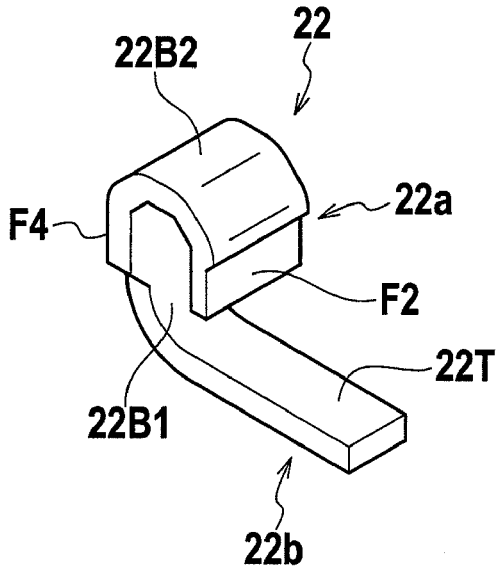

An embodiment of the present invention is explained in detail with reference to the accompanying drawings. FIG. 2 is an overall perspective view of a socket according to the present embodiment, FIG. 3 is a cross section taken along a line in FIG. 2, FIGS. 4A and 4B are perspective views of a socket contact, where FIG. 4A is a view seen from inside of the socket and FIG. 4B is a view seen from outside of the socket, FIG. 5 is an overall perspective view of a header, FIG. 6 is a cross section taken along a line VI-VI in FIG. 5, and FIGS. 7A and 7B are perspective views of a header contact, where FIG. 7A is a view seen from inside of the header and FIG. 7B is a view seen from outside of the header.

Figure 5:
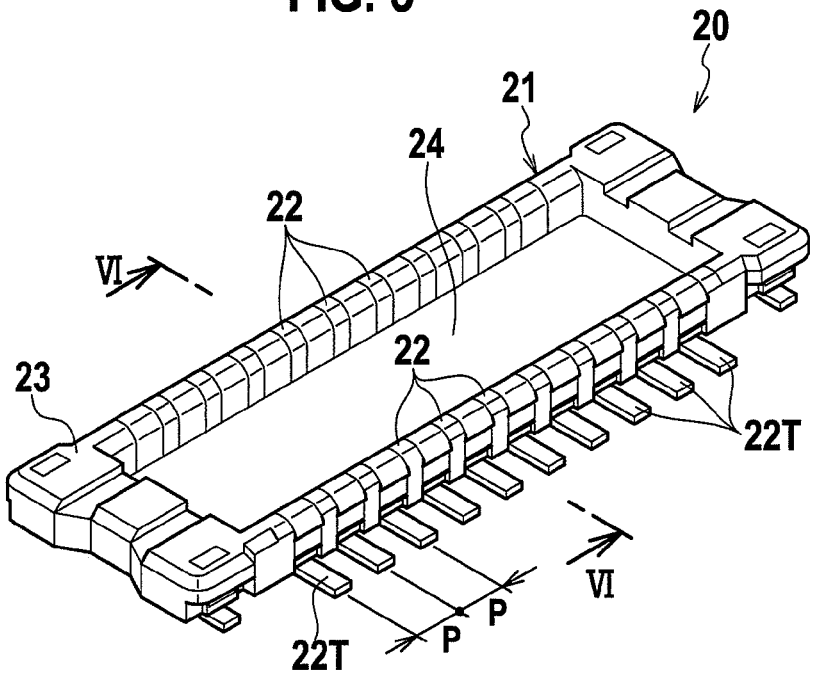
FIG. 5 is an overall perspective view of a header that is a counterpart of the socket as the connector connecting body according to the embodiment.

A connector C according to the present embodiment includes a socket 10 as shown in FIG. 2, which is one of connector connecting bodies, and a header 20 as shown in FIG. 5, which is the other connector connecting body.

The socket 10 includes a socket housing (housing) 11 that is molded of insulating synthetic resin generally in a rectangular shape in top plan, and plural socket contacts 12 that are attached along opposed long sides of the socket housing 11 at a predetermined pith p, as shown in FIG. 2.

The socket housing 11 includes a peripheral wall 13 that is formed continuously around the periphery of the housing in an approximately rectangular loop, and an approximately rectangular island 14 that is formed in the center of the housing with predetermined clearance from the peripheral wall 13. A fitting groove 15 for fitting the header 20 is formed between the peripheral wall 13 and the island 14.

The socket contact 12 is formed by molding of a band-like metallic material having a predetermined thickness in a curved shape, as shown in FIGS. 4A and 4B. An end bent upward from a first bend 12B1 is bent inward, thereby forming a second bend 12B2 on a distal end 12*a* of the socket contact 12. A third bend 12B3 bent in an inverted-U shape is formed on a proximal end 12*b*, and a flat connecting terminal 12T is provided at a distal end of the third bend 12B3.

As shown in FIG. 3, the socket contacts 12 are attached to the socket housing 11 so that the first bends 12B1 protrude into the fitting groove 15 in a state where the third bends 12B3 are fitted into recesses 13H1 formed inside the peripheral wall 13 and the second bends 12B2 are fitted into recesses 13H2 formed on a lower surface of the island 14.

In this state, the connecting terminals 12T of the socket contacts 12 protrude outward from a lower edge of the peripheral wall 13. The connecting terminals 12T are soldered to a conductive pattern (printed wiring pattern) of a first circuit substrate (not shown).

Meanwhile, the header 20 includes a header housing 21 that is formed like the socket housing 11 by molding of insulating synthetic resin generally in a rectangular shape approximately similar to the socket housing 11, and plural header contacts 22 that are attached along opposed long sides of the header housing 21 at a pitch p equal to the pitch p of the socket contacts 12, as shown in FIG. 5.

The header housing 21 includes a peripheral wall 23 that is formed continuously around the periphery of the housing in an approximately rectangular loop. An approximately flat bottom wall 24 is formed inside the peripheral wall 23.

As shown in FIGS. 7A and 7B, the header contact 22 is formed by bending a band-like metallic material having a predetermined thickness, like the socket contact 12. An end rising from a fourth bend 22B1 is bent in an inverted-U shape in a retracting direction, thereby forming a fifth bend 22B2 on a distal end 22*a* of the header contact 22. On a proximal end 22*b*, an approximately flat connecting terminal 22T is provided.

The header contacts 22 are attached to the header housing 21 so that the fifth bends 22B2 are fitted over the top of the peripheral wall 23 and the proximal ends 22*b* are passed through a lower portion of the peripheral wall 23, as shown in FIG. 6.

In this state, the connecting terminals 22T of the header contacts 22 protrude outward from a lower edge of the peripheral wall 23. The connecting terminals 22T are soldered to a conductive pattern (printed wiring pattern) of a second circuit substrate (not shown).

Figure 8:
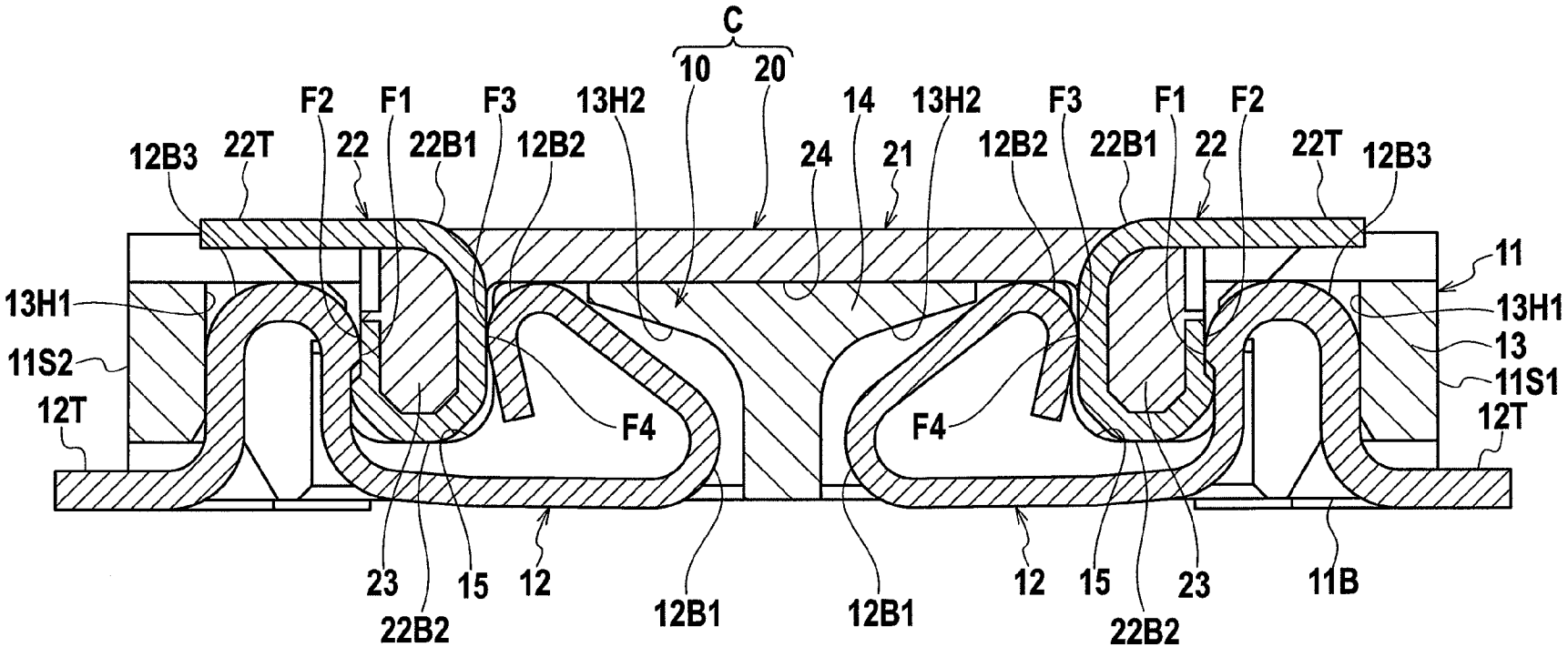
FIG. 8 is a cross section showing a state in which the socket and the header of a connector according to the embodiment are fitted.

FIG. 8 is a cross section showing a state in which the socket and the header are fitted. As shown in FIG. 8, the peripheral wall 23 of the header housing 21 is fitted into the fitting groove 15 of the socket housing 11. At this time, an outer surface F1 (see FIGS. 4A and 4B) of the third bend 12B3 of the socket contact 12 on the side of the distal end 12*a*, and an outer surface F2 (see FIGS. 7A and 7B) of the fifth bend 2282 of the header contact 22 on the distal end 22*a* are elastically contacted with each other. In addition, an outer surface F3 (see FIGS. 4A and 4B) of the second bend 1282 of the socket contact 12 is elastically contacted with a flat outer surface F4 (see FIGS. 7A and 7B) between the fourth bend 22B1 and the fifth bend 22B2 of the header contact 22. Accordingly, the socket contact 12 and the header contact 22 are electrically connected to each other. Consequently, the conductive pattern of the first circuit substrate and the conductive pattern of the second circuit substrate are electrically connected to each other.

As shown in FIG. 2, fitting metals 30 are mounted on both ends of the socket housing 11 in the direction of the long sides. Attachment pieces 32*a* of the fitting metals 30 are soldered to the first circuit substrate, which tightly couples the socket 10 to the first circuit substrate, combined with the soldering of the connecting terminals 12T of the socket contacts 12.

Figure 9A:
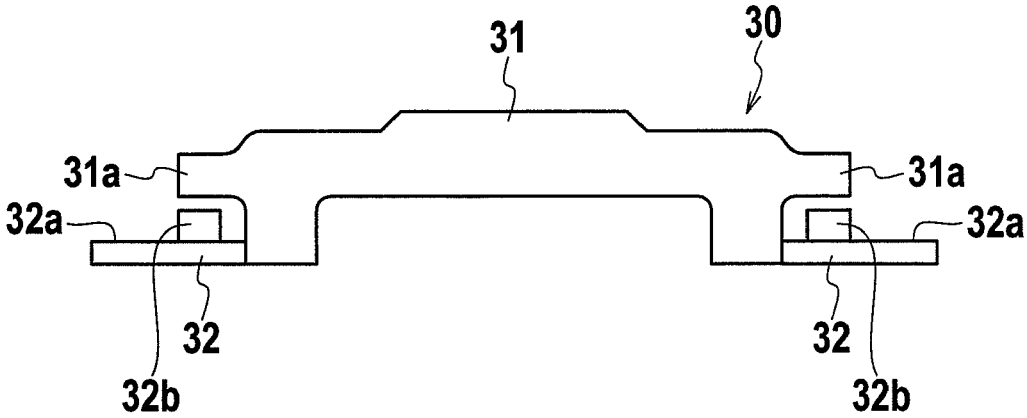
FIGS. 9A, 9B; and 9C are views showing a fitting metal included in the socket as the connector connecting body according to the embodiment, where
Figure 9B:
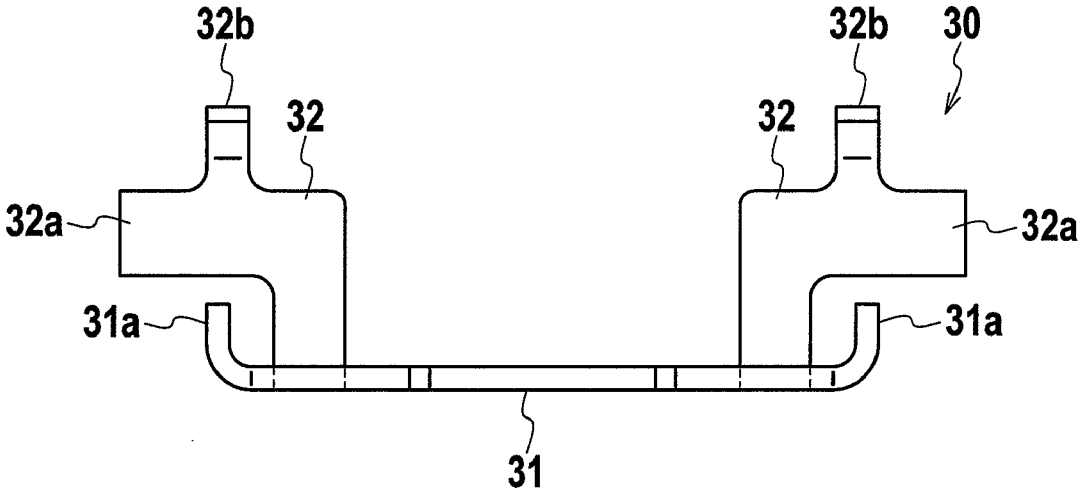
Figure 9C:
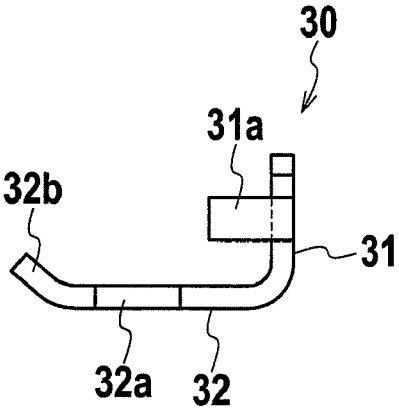
FIG. 9C is a side view.

The fitting metal 30 is shown by FIG. 9A as a front view, FIG. 9B as a plan view, and FIG. 9C as a side view. The fitting metal 30 is formed by press molding of a metal plate having a predetermined thickness. The main body of the fitting metal 30 is generally configured by a side plate (body) 31 extending in the direction of short sides of the socket housing 11, and bottom plates (body) 32 that are formed by folding lower portions of the side plate 31 on both ends approximately at a right angle toward the center of the direction of the long sides of the socket housing 11. The both ends of the bottom plates 32 are protruded from both sides of the socket housing 11 in the direction of the short sides, to form the attachment pieces 32*a* for the circuit substrate.

Figure 10A:
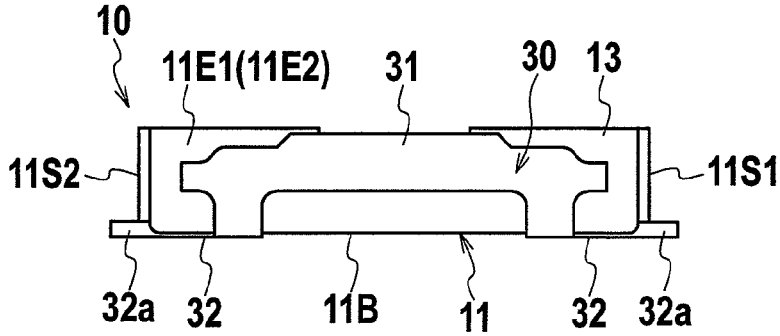
FIGS. 10A, 10B, and 10C are views showing a state in which the fitting metal included in the socket as the connector connecting body is attached to a socket housing according to the embodiment, where
Figure 10B:
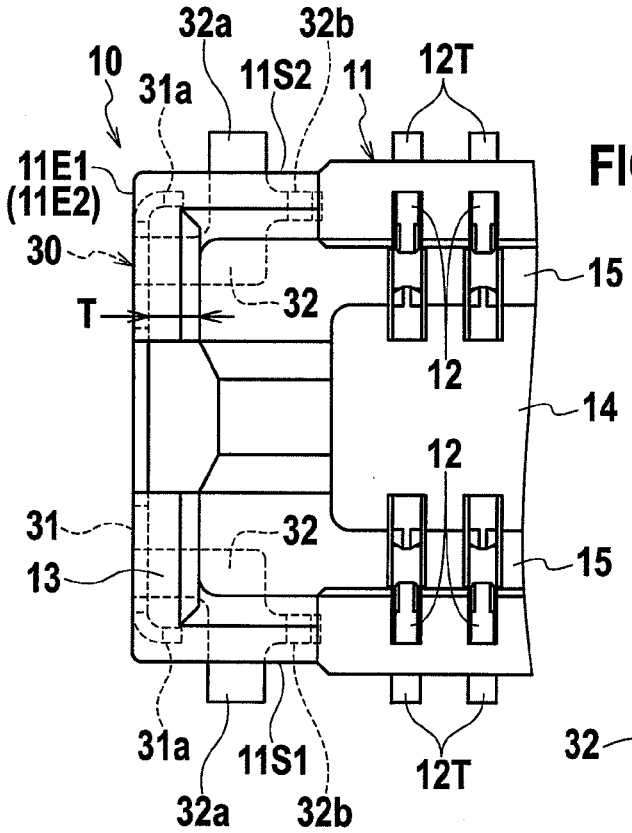
Figure 10C:
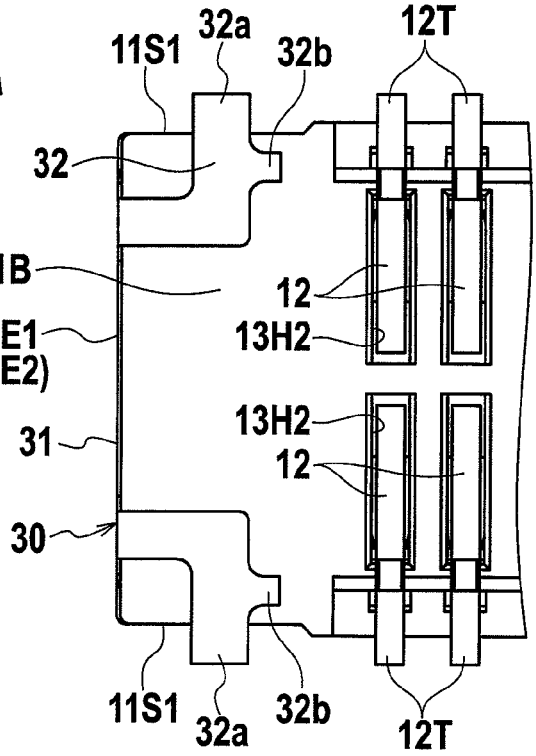

FIGS. 10A, 10B, and 10C are explanatory diagrams showing a state where the fitting metals 30 are attached, where FIG. 10A is a side view of the socket housing 11, FIG. 10B is a plan view of an end of the socket housing 11, and FIG. 10C is a bottom view of the end of the socket housing 11. As shown in FIGS. 10A, 10B, and 10C, when the socket housing 11 is molded, the fitting metals 30 are insert-molded in the socket housing 11. The fitting metals 30 are attached to the socket housing 11 in a state where the side plates 31 are exposed along outer walls (11E1 and 11E2) of the peripheral wall 13 of the socket housing 11.

That is, as shown in FIG. 10A, the side plates 31 are exposed along end surfaces (outer walls) 11E1 and 11E2 of the socket housing 11 in the direction of the long sides in a state of being approximately flush with the end surfaces 11E1 and 11E2. In addition, as shown in FIG. 10C, the bottom plates 32 are exposed on a bottom (outer wall) 11B of the socket housing 11.

The attachment pieces 32*a* to be soldered to the first circuit substrate protrude outward by a predetermined amount from opposed end surfaces 11S1 and 11S2 of the socket housing 11 in the width direction (shorter direction).

The fitting metal 30 includes anchors 31*a* and 32*b* that bite into the peripheral wall 13. Specifically, as also shown in FIG. 9C, the anchors 31*a* are formed by folding opposed ends of the side plate 31 in the longitudinal direction backward (toward the center of the direction of the long sides of the socket housing 11). The anchors 32*b* are formed by projecting the bottom plates 32 backward and folding the bottom plates 32 upward. The anchors 31*a* and 32*b* both bite and are buried into the socket housing 11 when the fitting metal 30 is simultaneously insert-molded in the socket housing 11. The anchors 31*a* and 32*b* extend in the different directions.

As described above, according to the present embodiment, the side plates 31 of the fitting metals 30 are exposed along the end surfaces 11E1 and 11E2 of the socket housing 11, and the bottom plates 32 are exposed along the bottom 11B of the socket housing 11. Therefore, the problem in that the peripheral wall 13 of the socket housing 11 is broadly divided by the fitting metal 30 into two portions is eliminated. Accordingly, rigidity and strength of the peripheral wall 13 can be increased. In addition, the thickness T of the socket housing 11 in the portions where the fitting metals 30 are provided can be easily set to a desired value. Thus, defective molding at the insert molding can be suppressed.

According to the present embodiment, the anchors 31*a* that bite into the socket housing 11 are provided on the opposed ends of the side plate 31 of the fitting metal 30 in the longitudinal direction. Accordingly, free end regions of the fitting metal 30 are decreased, so that the fitting metal 30 is not easily detached from the socket housing 11.

Further, according to the present embodiment, because the plural anchors 31*a* and 32*b* extending in the different directions are provided, the coupling strength of the fitting metals 30 with respect to the socket housing 11 against external forces in plural directions is ensured. Thus, the fitting metals 30 are not easily detached from the socket housing 11.

Because defects (such as defective molding or insufficient rigidity of the socket housing 11) due to the fitting metals 30 hardly occur on the socket 10, defects (such as insufficient coupling strength or defective appearance) occurring on the connector C as an assembly of the socket 10 and the header 20 is suppressed consequently.

Although the preferred embodiment of the present invention has been described above, the present invention is not limited thereto, and various modifications can be made. For example, in the above embodiment, the descriptions have been given of a case that the connector connecting body according to the present invention is embodied as the socket. However, the connector connecting body can be of course embodied as a header. Specifications such as the shape, the size, and the material of the housing, the contact and the like of the connector connecting body can be properly changed.

What is claimed is:

1. A connector connecting body, comprising:

a housing of an insulator defined by outer walls to which plural contacts to be soldered to a conductive pattern of a circuit substrate, and a fitting metal for fixture to the circuit substrate are attached, wherein the fitting metal comprises:

a plate-like body that is exposed and flush along one of the outer walls of the housing, the plate-like body having a side plate and at least one bottom plate, the side plate and the bottom plate extending generally perpendicular to each other, first anchors that are formed by folding the side plate of the plate-like body, the first anchors biting into a side of the housing, second anchors that are formed by the folding the bottom plate of the plate-like body, the second anchors projecting upwardly from the bottom plate and biting into a bottom of the housing, an attachment piece that protrudes from the plate-like body of the fitting metal to outside of the housing to be fixed to the circuit substrate, and wherein the second anchors extend in a different direction than that of the first anchors.

2. The connector connecting body according to claim 1, wherein the first and second anchors are respectively provided on opposing ends in a longitudinal direction of the plate-like body.

3. A connector comprising paired connector connecting bodies, wherein at least one of the paired connector connecting bodies comprises the connector connecting body according to claim 1.

4. The connector connecting body according to claim 1, wherein the attachment piece extends from the peripheral wall and in a width direction of the housing.

* * * * *